United States Patent [19]

Metcalf, II

[11] 4,298,918

[45] Nov. 3, 1981

[54] FLUORESCENT FIXTURE SOCKET

[75] Inventor: Paul T. Metcalf, II, Methuen, Mass.

[73] Assignee: Keene Corporation, New York, N.Y.

[21] Appl. No.: 159,370

[22] Filed: Jun. 13, 1980

[51] Int. Cl.[3] ..... F21S 3/00
[52] U.S. Cl. ..... 362/217; 339/56
[58] Field of Search ..... 362/217, 260; 339/176 L, 189 L, 191 L, 278 L, 50 R, 56

[56] References Cited

U.S. PATENT DOCUMENTS 2,455,333 11/1948 Harris ..... 362/217
2,687,516 8/1954 Schneiderman ..... 362/217

*Primary Examiner*—Donald P. Walsh
*Attorney, Agent, or Firm*—Gerald Levy

[57] ABSTRACT

An improved socket assembly for a fluorescent fixture is provided in which a terminal floats on a pair of guide posts. A spring exerts a biasing force on the terminal urging it into position to receive and retain the pins of a fluorescent tube.

6 Claims, 3 Drawing Figures

FIG. 1
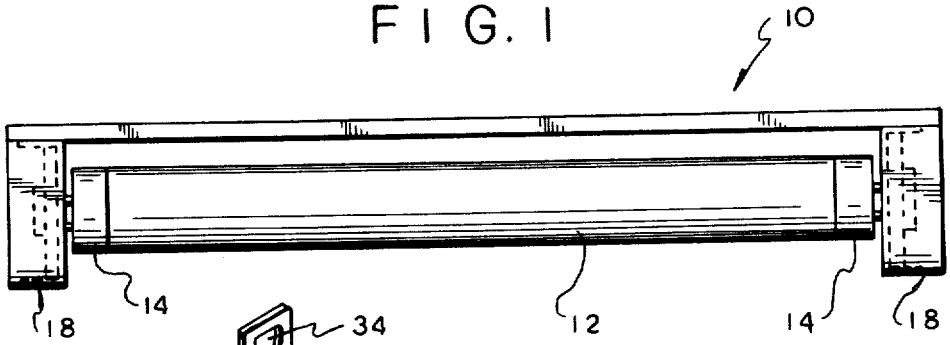
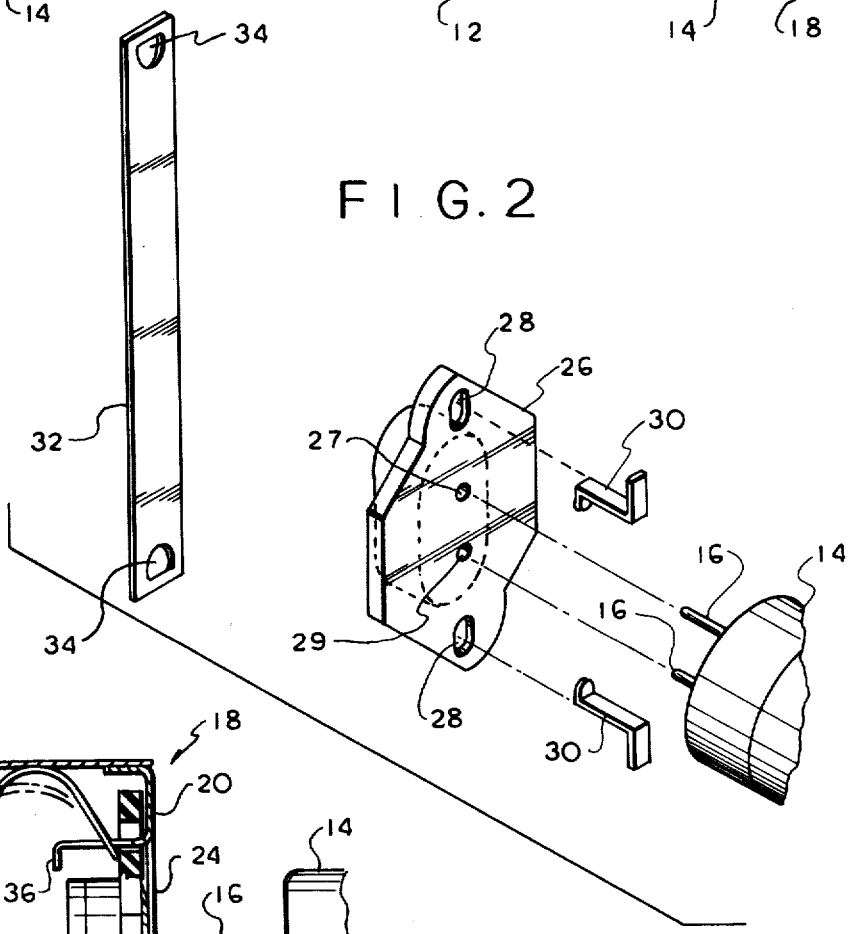
FIG. 2
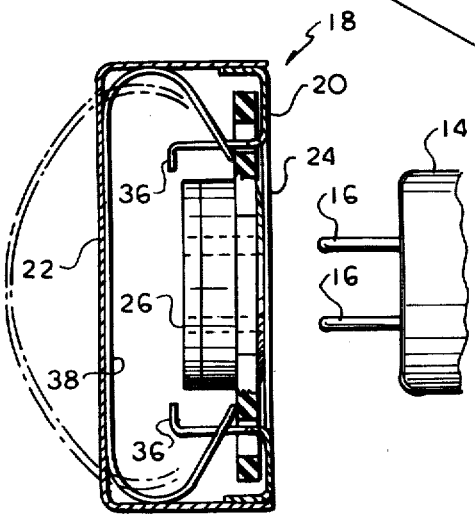
FIG. 3

FLUORESCENT FIXTURE SOCKET

BACKGROUND OF THE INVENTION

The present invention relates to fluorescent fixtures and in particular to an improved socket assembly for such fixtures which facilitates the placement and removal of elongated lamp tubes therein.

The conventional fluorescent light lamp comprises an elongated cylindrical tube, the ends of which are fitted with caps from which two pins extend. The tubes may range in length from several inches to several feet, depending upon the illumination required. The fluorescent lamp is activated by applying electric current to the pins through appropriate contact in sockets of the associated fixture. The sockets also serve to hold the lamp in position by providing supporting surfaces which engage the pins when the pins engage the contacts.

In order to install a fluorescent lamp tube in a conventional fixture, it is necessary that the installer first align the pins at both ends of the tube with openings in the socket and then push the tubes into the socket. Thereafter the tubes must be manually rotated so that the pins at both ends simultaneously engage the appropriate socket contacts and mechanically interlock with the socket support surfaces to ensure that the necessary electrical and mechanical interconnections are made. Any misalignment of the ends of the tube or premature rotation of the tube could result in a defective electrical or mechanical connection or both.

The opening in the socket is on the order of a ¼ of an inch. Thus it should be apparent that the greater the tube length, the more difficult it becomes to maintain the alignment of the tube ends for purposes of inserting both sets of pins at opposite ends of the lamp into their respective sockets. In addition, the installer when rotating the lamps must be certain that both ends are rotated properly to make the necessary electrical connections. This has caused problems to experienced electricians as well as home owners faced with the task of replacing a spent fluorescent lamp.

Heretofore numerous attempts have been made to facilitate replacement of fluorescent tubes. In my commonly assigned U.S. Pat. No. 4,101,959 a fluorescent fixture is disclosed wherein guides serve to receive the pins of an associated fluorescent tube, align the tube and rotate the tube to ensure engagement between the pins and socket contacts. Other arrangements to facilitate the mounting of elongated fluorescent lamps are disclosed in U.S. Pat. Nos. 2,446,461; 2,452,137; and 3,065,343. While these arrangements do simplify the task of replacing fluorescent tubes, they require relatively complex molded parts and assemblies.

In view of the above, it is a principal object of the present invention to provide an improved fluorescent fixture socket assembly which simplifies the task of lamp installation.

A further object is to provide such a socket which may readily be assembled and which utilizes conventional or easily manufactured parts.

A still further object of the present invention is to provide an improved socket construction which is compatible with conventional fluorescent fixtures and may be incorporated therein with a minimum of design change.

A still further object is to provide such a socket construction which is relatively inexpensive and will not affect the overall cost of the resultant light fixture.

SUMMARY OF THE INVENTION

The above and other beneficial objects and advantages are obtained in accordance with the present invention by providing a fluorescent light fixture with spring loaded socket assemblies at each end. The socket assemblies comprise a housing having front and rear surfaces with an opening in the front surface. A fluorescent terminal is mounted within the housing and fits through the opening. A pair of posts are mounted within the housing to the front surface extending rearwardly on opposite sides of the opening. The terminal includes surfaces defining bores extending therethrough to which the posts extend. A flat strip of spring material is positioned within the housing with its opposite ends engaging the rear of the terminal and its center portion engaging the rear surface of the housing so that the spring material resiliently biases the terminal toward the housing front surface.

BRIEF DESCRIPTION OF THE DRAWINGS

In the accompanying drawings:

FIG. 1 is a side elevational view of a fluorescent fixture incorporating the present invention;

FIG. 2 is an exploded view of the component parts of the fluorescent fixture socket assembly; and FIG. 3 is a side elevational sectional view of the fluorescent fixture socket assembly of the present invention.

DETAILED DESCRIPTION OF THE PREFERRED EMBODIMENT

Reference is now made to the drawings wherein an improved fluorescent light fixture 10 in accordance with the present invention is shown. The fixture is depicted schematically and it should be made clear at the outset that the present invention is in no way restricted to any particular type of fluorescent fixture or housing and would be equally applicable to virtually any type of fluorescent fixture designed to accommodate elongated fluorescent tubes.

The fixture 10 is formed with compartments which contain therein one or more elongated fluorescent lamps 12. The lamps are of conventional design and comprise elongated glass tubes having caps 14 at the ends thereof. A pair of pins 16 extend from the caps. The pins serve to enable electrical connections to be made between the lamp and the associated wiring (not shown) of the fixture 10. The pins also serve to support the lamp in position.

In accordance with the present invention there is mounted at each end of fixture 10 a socket assembly 18. The details of the components of the socket assemblies 18 are shown in FIGS. 2 and 3. Accordingly, the socket assembly comprises a housing having a front surface 20 (directed toward the lamp 12) and a rear surface 22 opposite the front surface. The assemblies are secured to the fixture through appropriate screws or rivets extending through the rear on a top surface to the fixture housing.

An opening 24 is defined within the front surface 20. A terminal 26 is mounted within housing 18 aligned with opening 24. Terminal 26 is of conventional design and commercially available. It comprises a molded plastic body portion containing therein contact openings 27, 29 designed to receive pins 16 and bring them into electrical connection with a set of contacts. The contacts are connected through wiring (not shown) within the fixture to the current supply.

The body of terminal 26 is also provided with a pair of holes 28 extending therethrough. The holes are positioned on opposite sides of opening 24 in front surface 20 when the terminal is positioned as shown in FIG. 3.

A pair of mounting posts 30 are secured to or formed from the front surface 20 of housing 18 extending toward the rear surface 22. The posts 30 fit through the openings 28 of terminal 26 so that the terminal in effect "floats" on the posts which serve as guides restricting the movement of the terminal toward and away from opening 24 and preventing rotation. The posts are secured to or formed from the front of the housing 20 thereby providing rigid guides for the terminal 26. A strip 32 of flat spring steel is also provided with a hole 34 extending through each end of the strip. As shown in FIG. 3 the holes 34 are each fitted about one of the posts 30. To this end, the top portion 36 of each post 30 is bent inwardly (i.e., toward the other post) so as to capture the ends 34 of spring 32 in position. The length of spring 32 is sufficient to ensure that the center portion 30 of the spring engages the rear surface 22 of housing 18. Thus, as shown in FIG. 3 the spring 32 exerts a biasing force on terminal 26 urging the terminal toward the opening 24 in front surface 20 of housing 18.

In use, the pins 16 of a fluorescent tube 12 are inserted into the contact holes in one terminal block 26 and the installer urges the bulb toward that end of the fixture. With slight pressure the biasing force of spring 32 is overcome thereby permitting the terminal 26 to ride rearwardly on post 30, enabling the pins at the opposite end of the tube to clear the socket assembly 18 at that end. The pin at the far end of the fixture can then be aligned with the contacts in the opposite socket assembly. When the installer releases the tube, spring 32 serves to urge the terminal 26 against the front surface of housing 20 thereby capturing the bulb in position. By providing similar spring loaded socket assemblies 18 at both ends of the fixture, it does not matter which end of the fixture the installer inserts first.

To remove a fluorescent tube, the installer merely urges the tube in one direction to overcome the spring force exerted by the socket assembly on that end of the tube. This will free the pins from the contacts at the opposite end of the tube whereafter the installer can totally disconnect the tube.

Thus, it can be seen that a relatively simple yet effective means is provided to facilitate the installation and removal of fluorescent tubes.

I claim:

1. A fluorescent fixture socket assembly comprising:

a housing having front and rear surfaces;

an opening in said front surface;

a fluorescent terminal mounted within said housing and accessible through said opening, said terminal including a body portion containing a pair of fluorescent tube contacts and having a pair of holes extending therethrough on opposite sides of said contact;

a pair of posts secured or formed within said housing to said front surface and extending rearwardly on opposite sides of said opening, said posts each passing through one of said body portion holes whereby said terminal floats on said posts; and, a strip of flat spring material having opposite end portions and a center portion, said end portions each engaging said terminal body portion and said center portion engaging said housing rear surface whereby said spring material resiliently biases said terminal toward said housing front surface.

2. The assembly in accordance with claim 1 wherein each of said spring end portion has an opening therethrough through which one of said posts extends; each of said posts includes a shank portion extending generally perpendicular to said housing front surface and a rear end portion extending parallel to said front surface; and each of said posts passes through one of said spring openings and said post rear end portions capture said spring end portions.

3. The assembly in accordance with claim 2 wherein the post end portions are directed toward each other.

4. A fluorescent light fixture including:

an elongated frame;

a first socket assembly mounted at one end of said frame, said assembly comprising:

a housing having front and rear surfaces;

an opening in said front surface;

a fluorescent terminal mounted within said housing and accessible through said opening, said terminal including a body portion containing a pair of fluorescent tube contacts and having a pair of holes extending therethrough on opposite sides of said contact;

a pair of posts mounted within said housing to said front surface and extending rearwardly on opposite sides of said opening, said posts each passing through one of said body portion holes whereby said terminal floats on said posts; and a strip of flat spring material having opposite end portions and a center portion, said end portions each engaging said terminal body portion and said center portion engaging said housing rear surface whereby said spring material resiliently biases said terminal toward said housing front surface.

5. A fluorescent light fixture in accordance with claim 4 further comprising:

a second socket assembly mounted at the opposite end of said frame; and an elongated fluorescent light tube extending between said socket assemblies.

6. The fixture in accordance with claim 5 wherein said first and second socket assemblies are identical.

* * * * *